US007063545B2

(12) United States Patent
Zu et al.

(10) Patent No.: US 7,063,545 B2
(45) Date of Patent: Jun. 20, 2006

(54) ELECTRICAL CONNECTOR HAVING TERMINAL POSITIONING STRUCTURE

(75) Inventors: Jin Ping Zu, KUnsan (CN); Chun Sheng Li, Kunsan (CN); Xiao Liang Chen, KUnsan (CN); Feng Zhu, Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/937,936

(22) Filed: Sep. 9, 2004

(65) Prior Publication Data

US 2005/0054223 A1 Mar. 10, 2005

(30) Foreign Application Priority Data

Sep. 9, 2003 (CN) ..... 03 2 78520 U

(51) Int. Cl.
*H01R 12/00* (2006.01)

(52) U.S. Cl. ..... 439/79

(58) Field of Classification Search ..... 439/79, 439/80, 541.5, 607

See application file for complete search history.

(56) References Cited

U.S. PATENT DOCUMENTS 4,857,017 A * 8/1989 Erk ..... 439/695
5,827,077 A * 10/1998 Fukuda ..... 439/79
5,989,041 A * 11/1999 Lin ..... 439/79

FOREIGN PATENT DOCUMENTS

CN ZL02247370.X 7/2003

* cited by examiner

*Primary Examiner*—Ross Gushi
(74) *Attorney, Agent, or Firm*—Wei Te Chung

(57) ABSTRACT

An electrical connector (1) includes an insulative housing (10) and a number of terminal (20) received in the housing. The housing includes a mating portion (11), a number of upper and lower terminal receiving passageways (131, 132), a pair of sidewalls (14) extending rearwardly from the mating portion and a number of ribs (16) and recesses (17) formed between the pair of sidewalls. Each terminal includes a contact portion (21), an engaging portion (22) perpendicularly and downwardly extending from the contact portion, and a soldering portion (23) connecting with the engaging portion. The engaging portions (221, 222) of the terminals extend out of the upper and the lower terminal receiving passageways and are respectively retained in the recesses and abutting against the ribs. The ribs and the recesses form a better terminal positioning structure.

7 Claims, 4 Drawing Sheets

ELECTRICAL CONNECTOR HAVING TERMINAL POSITIONING STRUCTURE

BACKGROUND OF THE INVENTION

1. Field of the Invention

The present invention is related to an electrical connector, and more particularly to a high profile and high density electrical connector having a terminal positioning structure.

2. Description of Related Art

Generally, a high density electrical connector always has a very large number of electrical contacts and very small contact pitch for satisfying with the requirement of large data storage capacity and high transfer rates. The contacts used in such a high density electrical connector usually comprise long connecting portions for connecting to different electronic components on a printed circuit board. For avoiding mutual interference between electrical contacts, especially to high profile electrical connectors with long connecting portions, a spacer is typically employed to retain electrical contacts at a predetermined position. However, in applications, electrical contacts are easily subject to bending and deforming due to external bump or shock, thereby easily causing a unwanted short circuit and further resulting in more serious issues occurred in a system where the connector is assembled.

CN Utility Patent No. ZL02247370.X discloses an electrical connector including an insulative housing, a plurality of electrical contacts received in the insulative housing and an insulative protector. The insulative housing has a pair of sidewalls forming a space therebetween and the insulative protector is received in the space for preventing the electrical contacts from being bent and deformed due to external bump or shock. However, the insulative protector has a thin wall which has bad heat-resistant performance, therefore the insulative protector is easily deformed in use thereby resulting in malfunction of protection to the electrical contacts.

Hence, it is requisite to provide an electrical connector having an improved terminal positioning structure.

SUMMARY OF THE INVENTION

Accordingly, an object of the present invention is to provide an electrical connector which has an improved terminal positioning structure so as to steadily position terminals in an insulative housing and ensure the signal transmission of the whole electrical connector.

In order to achieve the object set forth, an electrical connector in accordance with the present invention comprises an insulative housing and a plurality of terminals received in the insulative housing. The insulative housing comprises a mating portion, a plurality of upper and lower terminal receiving passageways, a pair of sidewalls extending rearwardly from the mating portion and a plurality of ribs and recess formed between the pair of sidewalls. Each terminal comprises a contact portion, an engaging portion perpendicularly and downwardly extending from the contact portion, and a soldering portion connecting with a tail end of the engaging portion. The engaging portions of the terminals comprise first and second engaging portions respectively extending out of the upper and the lower terminal receiving passageway. The first engaging portions are received in the recesses and the second engaging portions abuts against the ribs.

Other objects, advantages and novel features of the invention will become more apparent from the following detailed description of the present embodiment when taken in conjunction with the accompanying drawings.

DETAILED DESCRIPTION OF THE INVENTION

Reference will now be made in detail to the preferred embodiment of the present invention.

Figure 1:
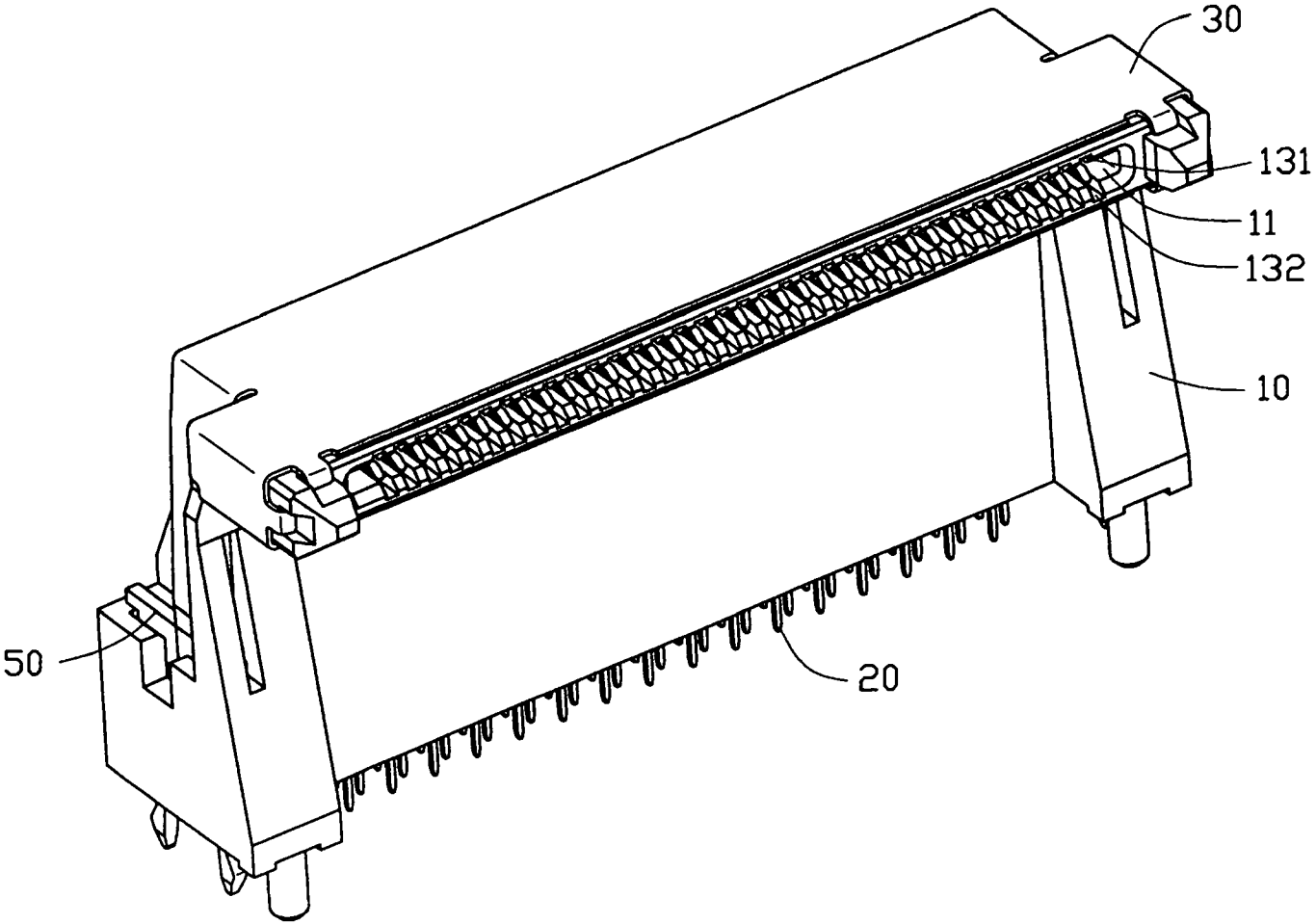
FIG. 1 is a perspective view of an electrical connector in accordance with the present invention.
Figure 2:
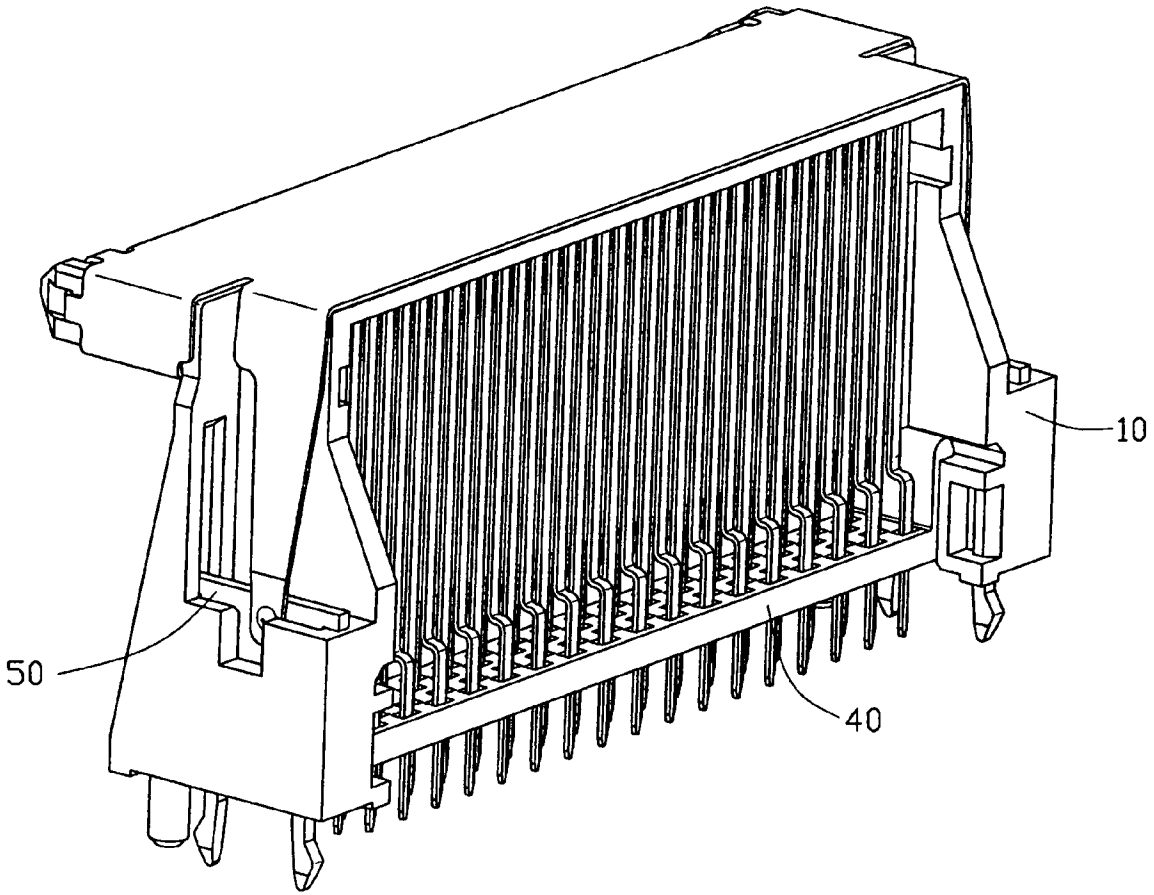
FIG. 2 is a perspective view of the electrical connector from another aspect.
Figure 3:
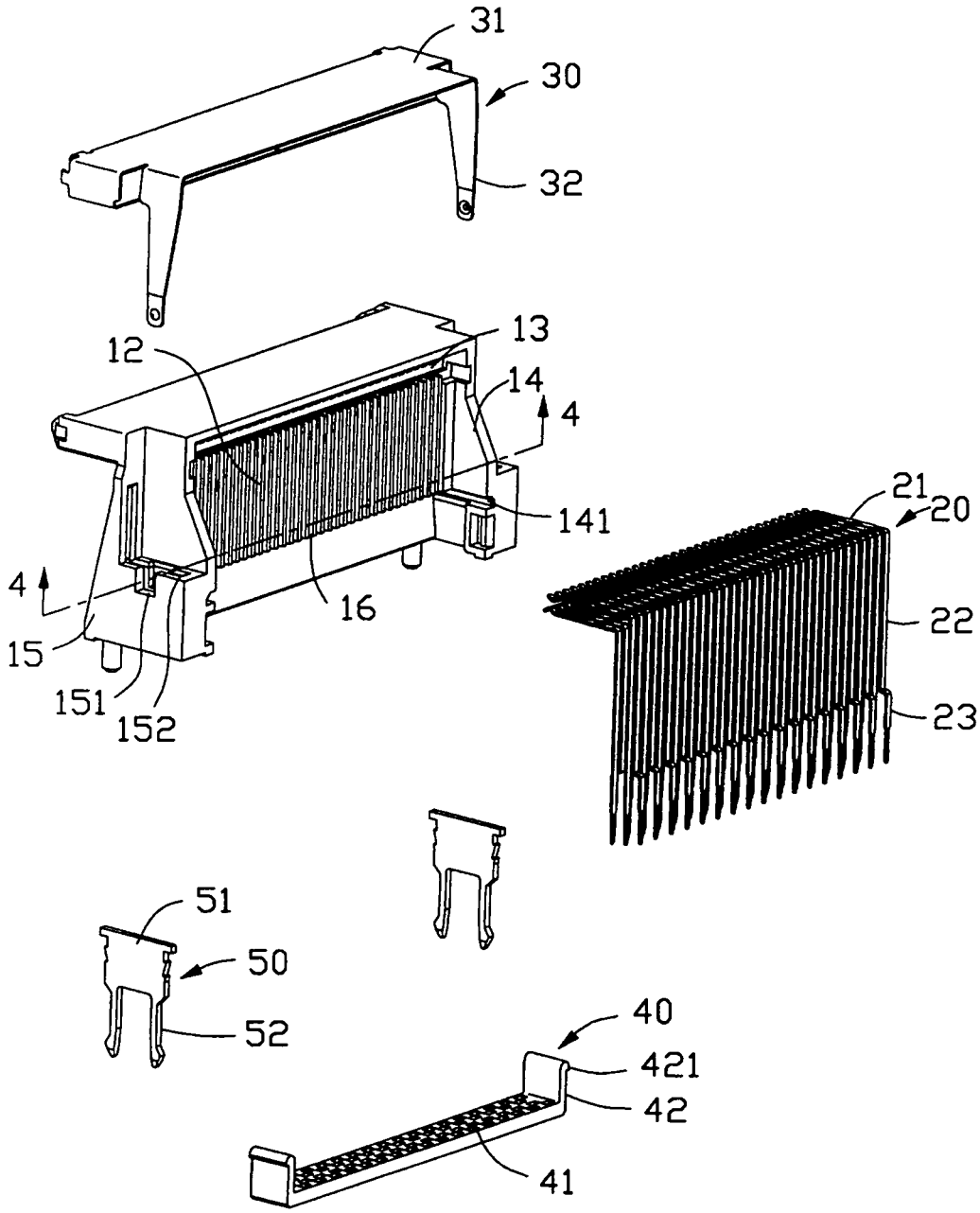
FIG. 3 is an exploded, perspective view of the electrical connector.

Referring to FIGS. 1 to 3, an electrical connector 1 in accordance with the present invention comprises an insulative housing 10, a plurality of terminals 20 received in the insulative housing 10, a shielding shell 30 retained in the insulative housing 10, a spacer 40 attached to the insulative housing 10 and a pair of board locks 50.

The insulative housing 10 comprises a mating portion 11 located in an upper portion thereof for mating with a complementary connector (not shown), a rear face 12 opposite to the mating portion 11, a plurality of terminal receiving passageways 13 defined in the mating portion 11, a pair of trapezium-shaped sidewalls 14 extending rearwardly and downwardly from the mating portion 11, and a pair of platform 15 respectively formed outside of the sidewalls 14 and located in a lower portion of insulative housing 10. The terminal receiving passageways include a row of upper terminal receiving passageways 131 and a row of lower terminal receiving passageways 132 respectively located in a top and a bottom of the mating portion 11 and staggered with each other. The insulative housing 10 has a plurality of ribs 16 extending along a direction perpendicular to the terminal receiving passageways 13 of the mating portion 11, and a plurality of recesses 17 formed between adjacent two ribs 16. The plurality of ribs 16 and recesses 17 forms a better terminal positioning structure. Each sidewall 14 defines a horizontal slot 141 in the bottom thereof. Each platform 15 defines a groove 151 in an upper face thereof, and a slit 152 therethrough extending along a direction parallel to the terminal receiving passageways 13 for receiving a corresponding board lock 50 and communicating with the groove 151.

The plurality of terminals 20 includes first and second terminals 20 respectively received in the upper and lower terminal receiving passageways 13. Each terminal 20 comprises a contact portion 21, an engaging portion 22 perpendicularly and downwardly extending from the contact portion 21, and a soldering portion 23 connecting with a tail end of the engaging portion 22 and extending beyond the insulative housing 10. The engaging portions 22 of the terminals 20 include first and second engaging portions 221, 222 respectively extending out of the upper and the lower terminal receiving passageways 131, 132.

The shielding shell 30 has a elongated frame 31 enclosing the mating portion 11 of the insulative housing 10 and a pair of clamping arms 32 downwardly extending form a rear end of the elongate frame 31 and received in the grooves 151 of the platforms 15 of the insulative housing 10.

The spacer 40 is disposed under the ribs 16 and the recesses 17 of the insulative housing 10 and comprises a plurality of through holes (not labeled) therethrough for providing the terminals 20 to extending and a pair of engaging arms 42 respectively formed at opposite ends thereof. Each engaging arm 42 has a catch 421 formed at a free end thereof and outwardly extending, and received in the slot 141 of the sidewall 14, thereby the spacer 40 is assembled onto the insulative housing 10.

Each board lock 50 includes a plate-shaped base 51 received in the slit 152 of the platform 15 of the insulative housing 10 and a pair of engaging legs 52 downwardly extending from two opposite sides of the base 51.

Figure 4:
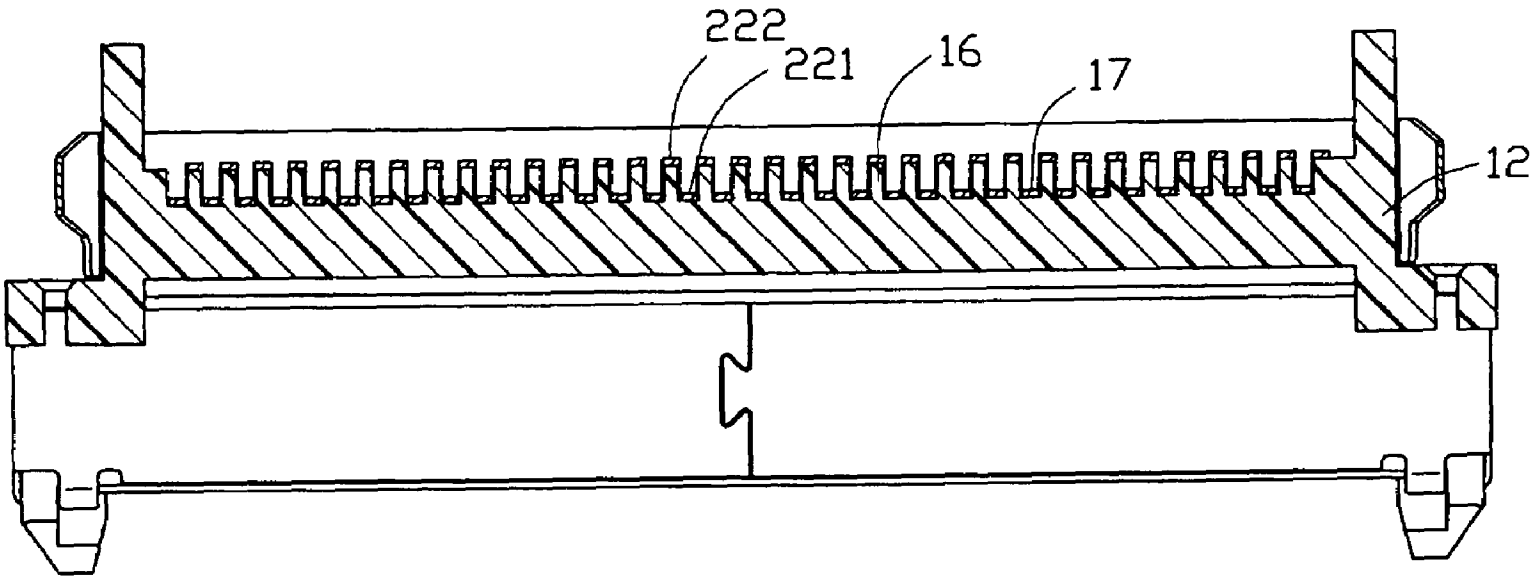
FIG. 4 is a cross-sectional view of the electrical connector taken along line 4—4 of FIG. 3.

Referring to FIG. 4 cooperatedly, in assembly, the contact portions 21 of the terminals 20 are respectively received in corresponding terminal receiving passageways 13 of the mating portion 11, and the engaging portions 22 extend perpendicularly and downwardly. The first engaging portions 221 of the first terminals 20 are retained in the recesses 17 and the second engaging portions 222 of the second terminals 20 abut against the ribs 16. Then the first and the second engaging portions 221, 222 are firmly pressed against the recesses 17 and the ribs 16 by an external comb-shaped tool (not shown) corresponding to the shape of the ribs 16 and the recesses 17. Subsequently, the catch 421 of each arm 42 of the spacer 40 engages with the slot 141 of the sidewall 14 of the insulative housing 10, so that the spacer 40 is assembled onto the insulative housing 10 and the soldering portions 23 of the terminals 20 are respectively inserted through the through holes of the spacer 40 to extend out of the insulative housing 10. Finally, the comb-shaped tool is unloaded. By means of the improved terminal positioning structure including the ribs 16 and the recesses 17 defined in the insulative housing, the terminals 20 can be securely retained in the insulative housing 10 so that the electrical connector 1 in accordance with the present invention has better and reliable signal transmission quality.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing comprising a mating portion, a rear face opposite to the mating portion, a plurality of upper and lower terminal receiving passageways defined in the mating portion and extending along a first direction, and a plurality of ribs and recesses staggeredly arranged in the rear face, each rib extending along a second direction perpendicular to the first direction; and a plurality of first and second terminals respectively received in the upper and lower terminal receiving passageways and each comprising a contact portion received in the terminal receiving passageway, an engaging portion perpendicularly extending from said contact portion and extending out of the terminal receiving passageway, and a soldering portion connecting with the engaging portion, the engaging portions of the first terminals being received in said recesses and the engaging portions of the second terminals abutting against said ribs, wherein said insulative housing comprises a pair of sidewalls extending rearwardly and downwardly from said mating portion, and said sidewall has a slot in a lower portion thereof.

2. The electrical connector as claimed in claim 1, further comprising a spacer attached to the insulative housing, and wherein the spacer comprises a pair of engaging arms respectively formed at opposite ends thereof and a plurality of through holes for providing insertion of said terminals.

3. The electrical connector as claimed in claim 2, wherein each engaging arm has a catch formed at a free end thereof and received in said slot for retaining the spacer on the insulative housing.

4. The electrical connector as claimed in claim 1, wherein said insulative housing comprises a platform formed outside of said sidewall and the platform defines a groove and a slit in the top face thereof.

5. The electrical connector as claimed in claim 4, further comprising a pair of board locks each having a base inserted into said slit and a pair of engaging leg downwardly extending from two opposite sides of said base.

6. The electrical connector as claimed in claim 4, further comprising a shielding shell substantially enclosing the mating portion.

7. The electrical connector as claimed in claim 6, wherein the shielding shell integrally has an elongated frame and a pair of clamping antis downwardly extending from said elongated frame and interferentially received in said groove of the platform.

* * * * *